United States Patent [19]

Hayashi

[11] 4,142,501

[45] Mar. 6, 1979

[54] INTERNAL COMBUSTION ENGINE HAVING IMPROVED CYLINDER HEAD CONFIGURATION

[75] Inventor: Yoshimasa Hayashi, Yokohama, Japan

[73] Assignee: Nissan Motor Company, Limited, Yokohama, Japan

[21] Appl. No.: 764,179

[22] Filed: Jan. 31, 1977

[30] Foreign Application Priority Data

Feb. 3, 1976 [JP] Japan ..... 51-10591

[51] Int. Cl.[2] ..... F01F 1/00

[52] U.S. Cl. ..... 123/193 H; 123/191 M; 123/193 CH

[58] Field of Search ..... 123/119 A, 148 C, 148 DS, 123/188 S, 191 R, 191 M, 193 R, 193 H, 193 CH

[56] References Cited

U.S. PATENT DOCUMENTS

| | | | |
|---|---|---|---|
| 2,305,208 | 12/1942 | Trammell | 123/191 M |
| 2,469,448 | 5/1949 | Barber | 123/191 M |
| 2,576,819 | 11/1951 | Angle | 123/193 H |
| 2,659,355 | 11/1953 | Layland | 123/191 M |
| 3,125,075 | 3/1964 | Wittek | 123/191 M |
| 3,154,061 | 10/1964 | Henry-Biabaud | 123/191 M |
| 3,263,659 | 8/1966 | Francois | 123/33 D |
| 3,408,994 | 11/1968 | Kraus | 123/191 M |
| 3,557,766 | 1/1971 | Stark | 123/191 R |
| 3,605,710 | 9/1971 | Helwig | 123/119 A |

FOREIGN PATENT DOCUMENTS

| | | | |
|---|---|---|---|
| 55827 | 9/1966 | Australia. | |
| 478289 | 12/1974 | Australia. | |
| 477486 | 1/1975 | Australia. | |
| 165232 | 2/1950 | Austria | 123/188 S |

*Primary Examiner*—Charles J. Myhre
*Assistant Examiner*—David D. Reynolds
*Attorney, Agent, or Firm*—Schwartz, Jeffery, Schwaab, Mack, Blumenthal & Koch

[57] ABSTRACT

A cylinder head of an internal combustion engine is formed with concavity. Two flat protruded portions are formed on the spherical surface of the concavity and their planes intersect each other at a location slightly below the vertex of the spherical surface. At the two flat protruded portions, intake and exhaust valve seats are disposed. A combustion chamber is defined by the spherical surface, the surfaces of the flat protruded portions and the piston crown.

23 Claims, 7 Drawing Figures

INTERNAL COMBUSTION ENGINE HAVING IMPROVED CYLINDER HEAD CONFIGURATION

This invention relates in general to an internal combustion engine, and more particularly to the cylinder head configuration of the engine which is designed to suppress the generation of nitrogen oxides during combustion.

It is the prime object of the present invention to provide an improved internal combustion engine which has low heat loss and is excellent in the volumetric efficiency and in scavenging efficiency.

Another object of the present invention is to provide an improved internal combustion engine in which the diameters of intake and exhaust valve heads can be increased without increase of the surface area and the volume of the combustion chamber of the engine.

A further object of the present invention is to provide an improved internal combustion engine which is arranged such that a considerably large amount of the exhaust gases of the engine is fed into the combustion chamber of the engine, and then the charge mixed with the exhaust gases is ignited by two spark plugs disposed in the combustion chamber, in which stable engine running and excellent driveability are obtained, suppressing greatly the generation of nitrogen oxides during the combustion of the charge in the combustion chamber.

Other objects, features and advantages of the internal combustion engine according to the present invention will become more apparent from the following description of the preferred embodiments thereof, taken in conjunction with the accompanying drawings, in which.

Figure 1:
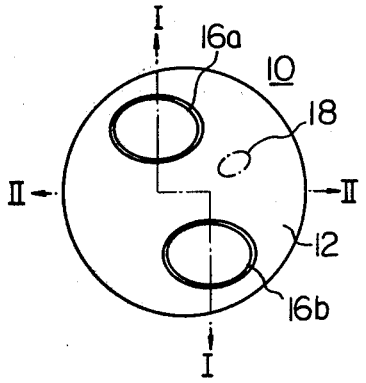
Fig. 1 PRIOR ART
FIG. 1 is a schematic plan view of a prior art cylinder head configuration of an internal combustion engine.
Figure 2:
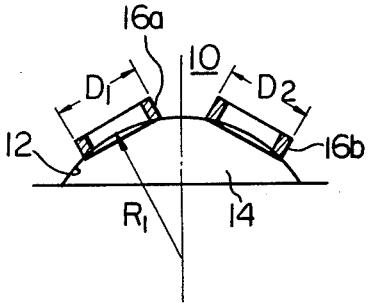
Fig. 2 PRIOR ART
FIG. 2 is a schematic cross-section taken along the line 1—1 of FIG. 1.
Figure 3:
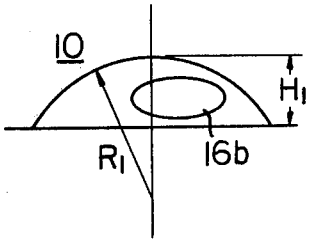
Fig. 3 PRIOR ART
FIG. 3 is a schematic cross-section taken along the line II—II of FIG. 1.

Referring to FIGS. 1 to 3, an example of a prior art cylinder head configuration of an internal combustion engine is shown. In this example, the cylinder head 10 is formed with a cavity 12 defining therein the top of a combustion chamber 14. The spherical surface of the cavity 12 is formed as a part of a sphere with its radius $R_1$ which is suitably selected. At the spherical surface, unevenness for installing intake and exhaust valve seats 16a and 16b and a spark plug 18 is usually formed. With the thus formed cylinder head 10, the combustion chamber surface area-to-volume ratio has been considerably decreased to obtain effective combustion of the charge in the combustion chamber. It is noted that this type of combustion chamber is particularly advantageous in an internal combustion engine in which a large amount of the exhaust gases is fed into the combustion chamber to mix with the charge in the combustion chamber, and the charge mixed with the gases is ignited by two spark plugs disposed in the combustion chamber. In an engine designed as such, the generation of nitrogen oxides in the combustion chamber is remarkedly suppressed by the effect of fed exhaust gases, and driveability of the vehicle may not be deteriorated by the effect of the charge ignition by the two spark plugs.

In order to promote the effective combustion of the charge by the ignition with the two spark plugs, it is desirable that the shape of the combustion chamber is simple and symmetrical with respect to the center axis of the combustion chamber. Additionally, it is also desirable that the two spark plugs are located opposite or symmetrically with respect to the center axis of the combustion chamber. In this connection, the above-described combustion chamber has been applied to the engine in which the charge mixed with a large amount of the exhaust gases is ignited by the two spark plugs.

However, the engine having the cylinder head configuration mentioned above has encountered problems in that if the diameters $D_1$ and $D_2$ of the intake and exhaust valve seats are increased to increase the diameters of the intake and exhaust valve heads in order to obtain desirable volumetric efficiency and scavenging efficiency of the engine, the height $H_1$ of the combustion chamber 14 is necessarily increased and accordingly both the surface area and volume of the combustion chamber are unavoidably increased. As a result of the increased combustion chamber surface area, the heat loss of the engine is increased. Additionally, it is required, for example, to form a protruding portion at the piston crown to obtain a desirable compression ratio of the engine since the combustion chamber volume is increased. For the reasons set forth, the ignition in the combustion chamber may fail and therefore the stable running of the engine and the driveability of the vehicle are unavoidably deteriorated.

In view of the above, the present invention contemplates to increase the diameters of the intake and exhaust valve heads without the increase of the surface area and the volume of the combustion chamber of the engine, thus solving the problems encountered in the prior art.

Figure 4:
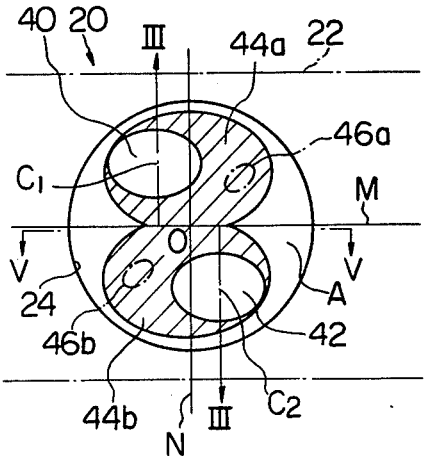
FIG. 4 is a schematic plan view of a part of a preferred embodiment of an internal combustion engine in accordance with the present invention.
Figure 5:
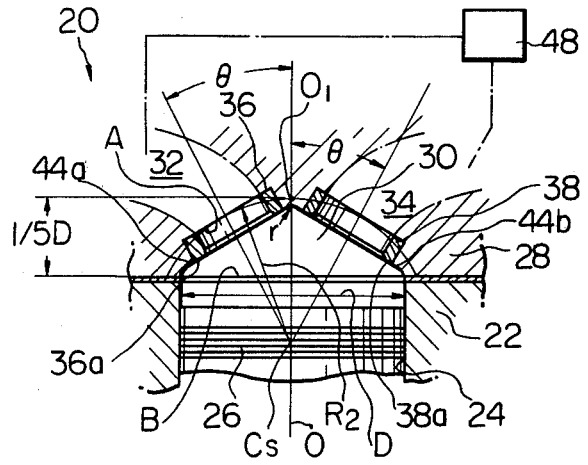
FIG. 5 is a schematic vertical cross-section taken along the line III—III of FIG. 4.
Figure 6:
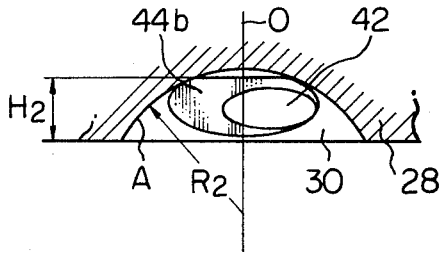
FIG. 6 is a schematic vertical cross-section taken along the line V—V of FIG. 4.

Referring now to FIGS. 4 to 6 of the drawings, there is shown a preferred embodiment of a part of an internal combustion engine, generally designated by the reference numeral 20, according to the present invention. As shown in FIG. 5, the engine 20 is composed of an engine proper (no numeral) including a straight elongate cylinder block 22. Formed, as usual, in the cylinder block 22 is a cylinder 24 or cylinders in which a piston 26 or pistons are reciprocally movable disposed. As seen in FIG. 5, a cylinder head 28 is secured to the upper surface of the cylinder block 22 to close the upper end of the cylinder 24. The cylinder head 28 is formed with a generally hemispherical concavity (no numeral) forming therein a combustion chamber 30 in which an air-fuel mixture charged therein through an intake port 32 is combusted and thereafter discharged through an exhaust port 34 into the environment. The spherical surface, represented by the symbol A, of the hemispherical concavity is fundamentally formed as a part of a sphere formed with a radius $R_2$ with its center $C_s$ lying in the center axis O of the cylinder 24. The radius $R_2$ is such that the distance between the vertex $O_1$ of the spherical surface A and the bottom plane B of the combustion chamber (the bottom plane of the cylinder head 28) is 0.2 times the diameter D of the cylinder bore, the vertex $O_1$ lying at a point at which the center axis O of the cylinder 24 passes through.

Securely disposed at the spherical surface A of the cylinder head concavity are intake and exhaust valve seats 36 and 38 on which intake and exhaust valve heads 40 and 42 (shown in FIG. 4) are respectively seatable. The combustion chamber 30 is, as customary, communicable through the intake and exhaust valve seats 36 and 38 with the intake and exhaust ports 32 and 34, respectively. As best seen in FIG. 4, the intake and exhaust valve heads 40 and 42 are disposed opposite to each other with respect to a longitudinal vertical plane M which passes through the center axis of the cylinder 24 or the center axes of the cylinders and is parallel with the longitudinal axis (not identified) of the cylinder block 22. It is to be noted that cylinder head 28 is formed at the spherical surface A with two land portions or flat portions 44*a* and 44*b* having their plane surfaces protruded from the spherical surface A. The intake and exhaust valve seats 36 and 38 are disposed respectively at the land portions 44*a* and 44*b* such that the annular flat surfaces 36*a* and 38*a*, exposed to combustion chamber 30, of the valve seats 36 and 38 are at the same planes as the surfaces of the two land portions 44*a* and 44*b* or may be parallel with the surfaces of the same land portions 44*a* and 44*b*. The plane surfaces of the two land portions 44*a* and 44*b* formed on the spherical surface A of the cylinder head concavity intersect or meet with each other at a location below the vertex $O_1$ of the spherical surface A or between the vertex $O_1$ and the extension of the bottom plane B of the cylinder head as seen in FIG. 5. This intersect portion is rounded as indicated by r in FIG. 5. It will be understood that the combustion chamber 30 is defined by the spherical surface A of the cylinder head concavity, the surfaces of the two land portions 44*a* and 44*b* formed on the spherical surface A, and the crown of the piston 26. Accordingly, the combustion chamber of this type chamber is similar to the so-called pent-roof type.

It will be appreciated that the diameters of the intake and exhaust valve heads 40 and 42 are sufficiently increased since the valve seats 36 and 38 for the intake and the exhaust valves 40 and 42 are respectively disposed at the two land portions 44*a* and 44*b*. Additionally, the height $H_2$ of the combustion chamber 30 may be considerably decreased as compared with the prior art hemispherical combustion chamber. In this connection, the surface area and the volume of the combustion chamber may, of course, be decreased as compared with the prior art engine with the intake and exhaust valve heads having diameters equal to those of the present invention.

Moreover, as best seen in FIG. 4, the centers $C_1$ and $C_2$ of the intake and exhaust valve heads 40 and 42 lie opposite to each other with respect to a lateral vertical plane N which is perpendicular to the longitudinal vertical plane M and are spaced apart from the lateral vertical plane N. Accordingly, the intake and exhaust valve heads 40 and 42 are respectively located far from the central portions of the plane surfaces of the two land portions 44*a* and 44*b* formed on the spherical surface A of the cylinder head concavity. As a result, the spaces for two spark plugs 46*a* and 46*b* are obtained on the plane surfaces of the land portions 44*a* and 44*b* in the case of an engine in which a considerably large amount, for example 25 to 40%, at maximum, of the intake air comprises exhaust gases which are fed or supplied by a device or means 48 to the combustion chamber of the engine to mix with the air-fuel mixture in the combustion chamber, and in which the air-fuel mixture mixed with the exhaust gases is ignited by the two spark plugs 46*a* and 46*b*. *The spark plugs 46a* and 46*b* may be located at the surface A other than the land portions 44*a* and 44*b*. In the thus arranged engine, it is preferable that the spark plugs 46*a* and 46*b* are arranged opposite and symmetrically with respect to the center axis O of the cylinder 24, and that the shape of the combustion chamber is as simple and symmetrical as possible. In this connection, it is desirable that the generally hemispherical combustion chamber according to the present invention is applied to the above-mentioned engine having the two spark plugs 46*a* and 46*b*. With the two spark plugs 44*a* and 44*b* arranged as shown in FIG. 4, the air-fuel mixture mixed with such a large amount of exhaust gases is effectively combusted in the combustion chamber 30 without deterioration of stable engine running and operation of the engine, suppressing the maximum temperature of the combustion to remarkedly decrease the generation of nitrogen oxides (NOx) in the combustion chamber.

It is to be noted that the intake and exhaust valve heads 40 and 42 are arranged such that axes passing respectively through the centers $C_1$ and $C_2$ of the valve heads 40 and 42 and perpendicular to the plane surfaces of the land portions 44*a* and 44*b* intersect the center axis O of the cylinder 24 at an angle $\theta$ of $22.5° \pm 10°$ as viewed from the direction parallel with the plane M, and accordingly the inclination angles of the flat surfaces of the land portions 44*a* and 44*b* with respect to the bottom plane B of the combustion chamber 30 fall into the angle of $22.5° \pm 10°$. This angular configuration of the intake and exhaust valve heads 40 and 42 is desirable in consideration of a valve operating mechanism connected to the stems of the intake and exhaust valve heads 40 and 42. Additionally, it is also desirable that the plane surfaces of the land portions 44*a* and 44*b* intersect each other at an angle greater than the right angle.

Figure 7:
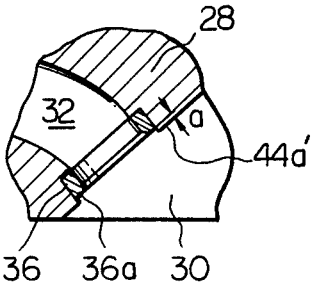
FIG. 7 is a cross-sectional view showing a modified example of the cylinder head configuration of the engine of FIG. 4.

FIG. 7 shows a modified configuration of the intake valve seat 36 and the land portion 44*a'*, in which the annular flat surface 36*a* of the intake valve seat 36 is sunk from the level of the plane surface of the land portion 44*a'*. In this case, the distance a between the surface 36*a* and the flat surface of the land portion 44*a'* is preferably set to about 1.2 mm.

While only the engine in which two spark plugs are disposed in each combustion chamber has been shown and described, it will be understood that the cylinder head configuration according to the present invention may be applied to engines in which only one spark plug is disposed in each combustion chamber thereof.

As is apparent from the foregoing discussion, according to the present invention, the diameters of the intake and exhaust valve heads can be increased without increase of the surface area and volume of the combustion chamber, and therefore the volumetric efficiency and the scavenging efficiency of the engine can be improved without increase of the heat loss of the engine. If the cylinder head configuration of the present invention is applied to the engine in which the charge mixed with the exhaust gases is ignited by two spark plugs disposed in each combustion chamber, the two spark plugs can be disposed at desirable locations to effectively combust the charge mixed with the exhaust gases, and therefore NOx generation in the combustion chamber is greatly suppressed. Additionally, since the shape of the combustion chamber is made simple in the engine according to the present invention, smooth combustion of the charge is carried out in the combustion chamber and accordingly the generation of the noxious unburned constituents such as carbon monoxide and hydrocarbons can be decreased.

What is claimed is:

1. An internal combustion engine including a cylinder block having therein a cylinder having a center axis in which a piston is reciprocally movably disposed, comprising:

a cylinder head secured to the cylinder block and being formed with a concave surface, said concave surface closing one end of the cylinder and forming part of a sphere, having a vertex, with its center at a point on the central axis of the cylinder, said cylinder head being formed on the spherical surface with two flat portions protruded from the level of the spherical surface, the planes of the two flat portions intersecting each other at a location between the vertex of the spherical surface and the level at which the cylinder head is secured to the cylinder block;

a combustion chamber defined by the spherical surface, the two flat portions of the cylinder head and the top of the piston; and intake and exhaust valve heads seatable, respectively, on intake and exhaust valve seats, the valve seats being, respectively, formed at the two flat portions of said cylinder head, each of said valve seats comprising annular flat surfaces parallel with the flat surface of said flat portion on which it is formed, said intake and exhaust valve heads being oppositely offset with respect to a longitudinal vertical plane passing through the center axis of the cylinder and parallel with the longitudinal axis of the cylinder block, the centers of said intake and exhaust valves lying opposite to each other with respect to a lateral vertical plane perpendicular to the longitudinal vertical plane and passing through the center axis of the cylinder, and spaced apart from the lateral vertical plane.

2. An internal combustion engine as claimed in claim 1, further comprising means for supplying exhaust gases of the engine into the combustion chamber.

3. An internal combustion engine as claimed in claim 2, further comprising two spark plugs which are respectively disposed at the two flat portions of said cylinder head, said two spark plugs being arranged opposite to each other with respect to the center axis of the cylinder.

4. An internal combustion engine as claimed in claim 1, in which the distance between the vertex of the spherical surface and the extension of the bottom plane of said cylinder head is about 0.2 times the diameter of the cylinder bore.

5. An internal combustion engine as claimed in claim 4, in which the planes of the two flat portions of said cylinder head intersect each other at an angle greater than a right angle so as to form a line of intersection parallel with the longitudinal vertical plane.

6. An internal combustion engine as claimed in claim 5, in which said intake and exhaust valve heads are arranged such that the axes passing respectively through the centers of the intake and exhaust valve heads and perpendicular to the plane surface of the two flat portions intersect the center axis of the cylinder at an angle ranging from 12.5 degrees to 32.5 degrees as viewed from the direction parallel with the longitudinal vertical plane.

7. An internal combustion engine as claimed in claim 1, in which the annular flat surfaces of said intake and exhaust valve seats are respectively sunk from the level of the planes of the two flat portions of said cylinder head, in which the distance between each of the annular flat surfaces of said intake and exhaust valve seats and each of the planes of the two flat portions is about 1.2 mm.

8. An internal combustion engine comprising a cylinder, and a piston reciprocally mounted in said cylinder, said cylinder comprising:

a central longitudinal axis;

a cylinder head closing one end of said cylinder attached to said cylinder block, said head being concave and forming a spherical surface with its center located at a point along the central longitudinal axis of said cylinder, said spherical surface having a vertex and comprising two flat portions which intersect each other at a location between the vertex of the spherical surface and the level at which said cylinder head is secured to said cylinder block;

a combustion chamber defined by said spherical surface, said two flat portions of said cylinder head and the top of said pistion;

intake and exhaust valve heads seatable, respectively, on intake and exhaust valve seats located in each of said two flat portions of said cylinder head, said intake and exhaust valve heads being disposed on opposite sides of a longitudinal vertical plane passing through the center axis of said cylinder, said longitudinal plane being parallel with the longitudinal axis of said cylinder block, the centers of said intake and exhaust valve seats lying opposite to each other with respect to a lateral vertical plane perpendicular to said longitudinal plane and passing through the central axis of said cylinder, the surface areas defined by the outermost peripheries of said intake and exhaust valve seats being smaller than those of the two flat portions, respectively;

means on at least one of said two flat portions for accomodating a spark plug;

means for recirculating exhaust gases leaving said combustion chamber back to said combustion chamber.

9. The engine as defined in claim 8, wherein each of said valve heads has an axis located perpendicular to the plane surfaces of the flat portion with which said valve head is aligned and said valve heads are arranged such that the said valve head axes intersect the central axis of said cylinder at an angle of between 12.5 degrees and 33.5 degrees.

10. The engine as defined by claim 8, wherein each of said flat portions comprises means for accomodating a spark plug.

11. The engine as defined by claim 10, wherein said engine comprises two spark plugs each of which is received by one of said accomodation means, said accomodation means being arranged on opposite sides of said central axis.

12. The engine as defined by claim 8, wherein the distance between the vertex of the spherical surface and the extension of the bottom plane of said cylinder head is about 0.2 times the diameter of said cylinder bore.

13. The engine as defined by claim 8, wherein said two flat portions intersect each other at an angle greater than a right angle.

14. An internal combustion engine as defined by claim 8, in which the annular flat surfaces of said intake and exhaust valve seats are respectively sunk from the level of the planes of the two flat portions of said cylinder head, in which the distance between each of the annular flat surfaces of said intake and exhaust valve seats and each of the planes of the two flat portions is about 1.2 mm.

15. An engine comprising:

a cylinder block having a central longitudinal axis;

at least one cylinder having a central axis, said cylinder comprising a cylinder head having an inner spherical surface and a piston mounted in said cylinder for reciprocal motion;

said inner surface of said cylinder head comprising a first and a second flat portion;

an intake valve seat mounted in said first flat portion and an exhaust valve seat located in said second flat portion;

an intake valve head seatable on said intake valve seat, and an exhaust valve head seatable on said exhaust valve seat, said intake and exhaust valve heads being oppositely offset to each other with respect to a longitudinal vertical plane passing through the central axis of said cylinder and parallel with said longitudinal axis of said cylinder block, the centers of said intake and exhaust valve heads lying opposite to each other with respect to a lateral vertical plane lying perpendicular to said longitudinal vertical plane and passing through said central axis of said cylinder; and, at least one of said flat portions comprising means for receiving a spark plug.

16. The engine as defined by claim 15, wherein each of said flat portions comprises means for receiving a spark plug.

17. The engine as defined by claim 16, wherein a spark plug is attached to each of said means on said flat portions.

18. The engine as defined by claim 17, wherein said spark plugs are located on opposite sides of said central longitudinal axis.

19. The engine as defined by claim 15, which further comprises means for recirculating exhaust gases leaving said combustion chamber.

20. The engine as defined by claim 15, wherein said spherical cylinder head is attached to said cylinder block along an attachment plane and the distance between said attachment plane and the vertex of said cylinder head is about 0.2 times the diameter of the bore of said cylinder.

21. The engine as defined by claim 15, wherein said two flat portions are arranged in planes located at greater than 90° to one another.

22. The engine as defined by claim 15, further comprising a first valve head and a second valve head, said first valve head being aligned with said intake valve seat and second valve head is aligned with said exhaust valve seat, the longitudinal axis of said first and second valve heads being at an angle of between 12.5 degrees and 33.5 degrees with the central axis of said cylinder.

23. An engine as defined by 15, wherein each of said valve seats comprises an annular flat surface which faces the interior of said cylinder and is spaced, in a direction away from the combustion chamber, from the planes of each of said flat portions by about 1.2 mm.

* * * * *